United States Patent [19]

Barker

[11] Patent Number: 4,638,410

[45] Date of Patent: Jan. 20, 1987

[54] DIVING HELMET

[76] Inventor: Randall R. Barker, 6200 Carswell Access Rd. #3, Fort Worth, Tex. 76114

[21] Appl. No.: 236,871

[22] Filed: Feb. 23, 1981

[51] Int. Cl.[4] ..... F21L 15/14

[52] U.S. Cl. ..... 362/105; 362/106; 362/267; 362/269; 128/201.11

[58] Field of Search ..... 362/105, 106, 267, 269; 128/201.11

[56] References Cited

U.S. PATENT DOCUMENTS

| | | | |
|---|---|---|---|
| 1,000,721 | 8/1911 | Cypra . | |
| 1,305,656 | 6/1919 | Long . | |
| 1,377,404 | 5/1921 | Deam . | |
| 1,501,409 | 6/1923 | Logan . | |
| 1,752,120 | 10/1927 | Taylor . | |
| 2,131,617 | 9/1938 | Cowden | 362/106 |
| 2,320,222 | 4/1942 | Crupi . | |
| 2,420,362 | 5/1947 | Ekleberry | 362/106 |
| 3,403,406 | 7/1966 | Weissberg | 2/68 |
| 3,852,587 | 12/1974 | Koehler | 240/60 |
| 3,978,527 | 9/1976 | Bednar | 2/68 |
| 3,869,604 | 3/1975 | Prochnow | 362/269 |
| 4,022,201 | 5/1977 | Diggs | 128/201.11 |

OTHER PUBLICATIONS

*Skin Diver,* Dec. 1978, pp. 32–33.

*Primary Examiner*—Donald P. Walsh
*Attorney, Agent, or Firm*—James E. Bradley

[57] ABSTRACT

A helmet has features that provide better illumination and allow it to be used for both snorkling and scuba diving. The helmut has a watertight cavity located in the top portion. A lamp is mounted in this cavity. The lamp can be oriented to various directions with respect to the helmet by rotating the lamp housing. The battery is also mounted in the cavity. The switch connected between the battery and the lamp is located in a recess formed in the exterior of the helmet. A flexible liner is releasably secured inside the interior of the helmet. The liner can be removed, if a diver's hood is used, such as in cold water.

11 Claims, 5 Drawing Figures

DIVING HELMET

BACKGROUND OF THE INVENTION

This invention relates in general to helmets for scuba divers, and in particular to an improved lighting system and features that allow the helmet to be used both for snorkling and scuba diving.

Scuba diving helmets are open at the bottom and at the face, similar to a motorcyclist helmet. One purpose of the helmet is to support a light. The light is mounted on the top of the helmet and is powered by a battery that is carried in a case strapped about the diver's body and connected to the light by a cord.

These helmets have several limitations. One problem is that the light will illuminate only in a single direction relative to the diver's face. Another problem is that the cord between the battery and light may tangle and become damaged. Switching on the light is sometimes cumbersome. Also, conventional helmets are not readily adapted to snorkle usage. The side of the helmet interferes with the snorkel, and there is nothing to retain the tube with the helmet when the user removes the mouthpiece. Even if a snorkel were adapted to be used with a prior art helmet, the weight of the helmet may cause tiring of the diver's neck muscles during snorkling, since during snorkeling the diver often floats on the surface face down.

Another problem arises from the need to wear a hood in cold water scuba diving. The helmet must be large enough to accomodate the hood. In warm water, when wearing a hood is uncomfortable, the helmet would be too loose if the hood is removed. Consequently, the diver either has to have two helmet sizes or has to always wear a hood, despite its discomfort in warm water.

SUMMARY OF THE INVENTION

The helmet of this invention has several features that make it more useful for snorkling and scuba diving. One or more lights are mounted in a cavity formed in the top of the helmet. A battery is also located in the cavity for powering the light, thus avoiding the need for a separate battery pack and cord. The lamp can be moved in various angles. The switch for powering the light is recessed and is located in the helmet for ready access. A snorkle bracket is provided for receiving the snorkle tube. The snorkle bracket is permanently fixed to the side of the helmet and has resilient fingers for gripping the snorkle tube. The helmet has a detachable liner that can be removed for use with a diver's hood.

DESCRIPTION OF THE PREFERRED EMBODIMENT

Figure 1:
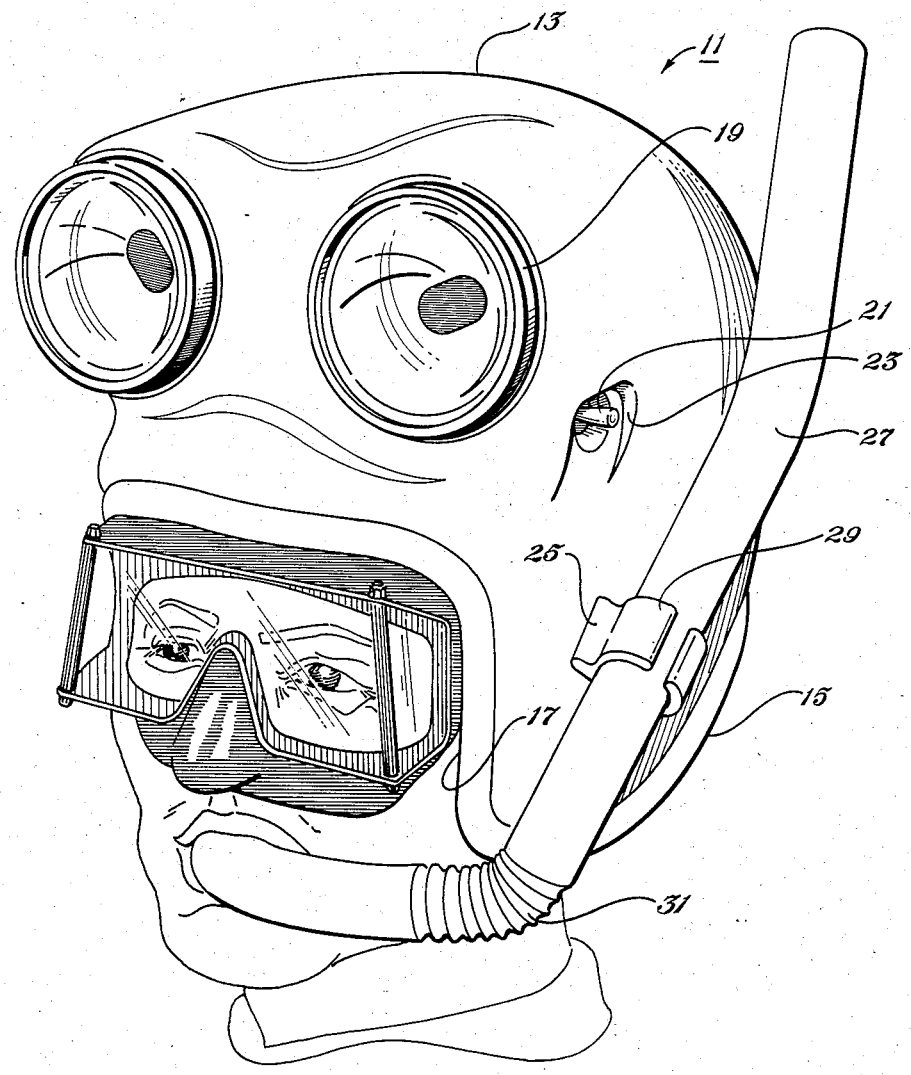
FIG. 1 is an enlarged perspective view of a helmet constructed in accordance with this invention.

Referring to FIG. 1, helmet 11 has a hard exterior surface 13 constructed of a strong and tough plastic material. The bottom 15 and face 17 of the helmet are open for receiving the head of the diver, as shown. A pair of lamp assemblies 19 are mounted in the top of the helmet. The lamp assemblies are activated by separate toggle switches 21 (only one shown) mounted on the sides of the helmet in recesses 23 (only one shown). Each recess 23 has a depth sufficient so that the top of the toggle switch 21 does not protrude past the exterior 13. The recess 23 also has sufficient dimensions to allow the diver to manipulate switch 21 even when wearing neoprene gloves. Each recess 23 is located slightly below one of the lights 19, and on a side.

A bracket 25 is permanently fixed to one side of helmet 11 for receiving a snorkle tube 27. Bracket 25 has two semi-circular, resilient arms 29. Arms 29 define a cylindrical member for tightly gripping tube 27. Snorkle tube 27 preferably has a flexible portion located between bracket 25 and the mouthpiece. This portion enables the snorkle tube 27 to clear the lower side edge of helmet 11.

Figure 2:
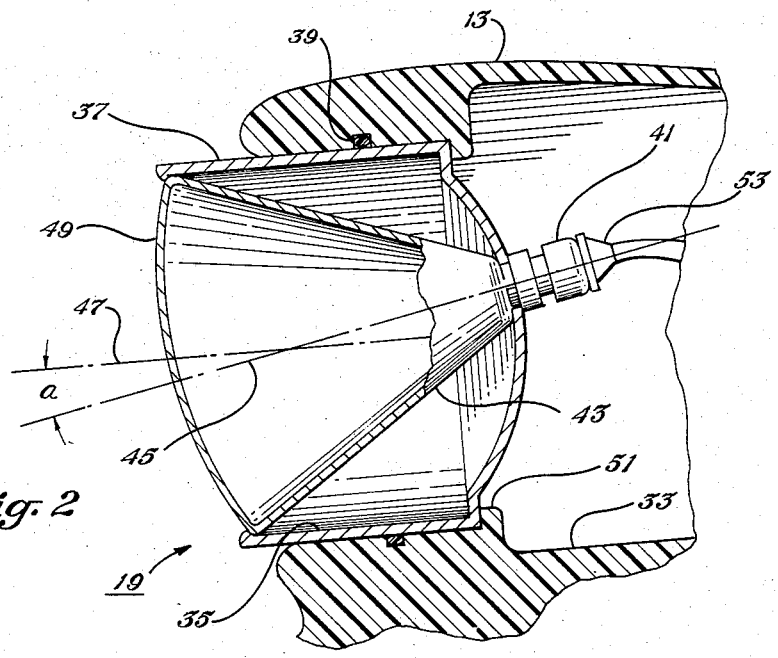
FIG. 2 is a vertical-sectional view of one of the lights of the helmet of FIG. 1, shown in a downwardly oriented position.

Referring to FIG. 2, each lamp assembly 19 is mounted in a separate lamp base or cavity 33 formed in the top of helmet 11 above the interior and below the exterior. Cavity 33 is watertight and has a cylindrical entrance 35. Entrance 35 is adapted to closely and slidably receive a lamp housing 37, which is also cylindrical. Seal means, such as a resilient O-ring 39, is located in a groove in entrance 35, and deforms against lamp housing 37 to prevent leakage of water from the exterior into cavity 33.

A light source 41, mounted in housing 37, may be a bulb type or sealed beam type. Light source 41 has a conical reflector 43 that surrounds and extends forwardly from the light source. The light source is mounted in the apex of the reflector 43 along the axis 45 of reflector 43. The conical reflector 43 is mounted in housing 37 at a selected acute angle a with respect to the axis 47 of the housing 37. Angle a is preferably 10 to 20 degrees. Axis 47 will be pointing slightly downward from the horizontal when the helmet is located on the diver's head, and when the diver is standing erect. Reflector 43 is sealed at the front by a lens 49. A shoulder 51 is formed at the rear of the entrance passage 35, to prevent further inward movement of lamp housing 37. A Teflon washer or other type of bearing (not shown) may be located between the back of housing 37 and shoulder 51 to facilitate rotation of housing 37 even under high inward pressure forces when underwater. A boot 53 secures to light source 41 a wire 55 (FIG. 4), which leads to the toggle switch 21.

Figure 3:
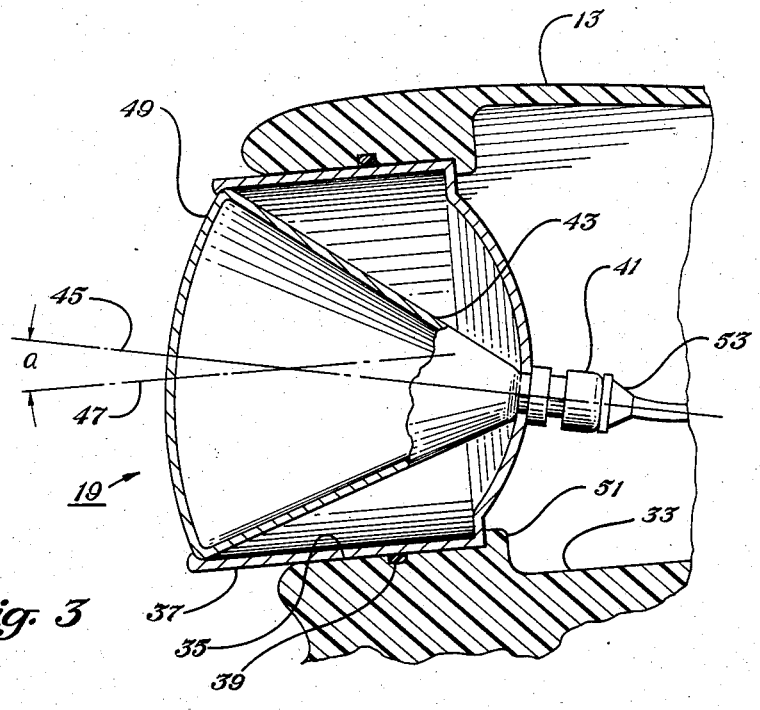
FIG. 3 is a vertical-sectional view of the one of the lights of the helmet of FIG. 1, shown in an upwardly oriented position.

Housing 37 is rotatable in cavity entrance 35, however, a stop (not shown) prevents rotation more than one turn in one direction, to avoid excessive twisting of wire 55. As shown in FIG. 3, when the housing 37 is rotated, the axis 45 sweeps in various directions, generating a conical surface of revolution with a full rotation. When rotated 180 degrees from the position shown in FIG. 2, the lamp will be pointing upwardly, as shown in FIG. 3.

Figure 4:
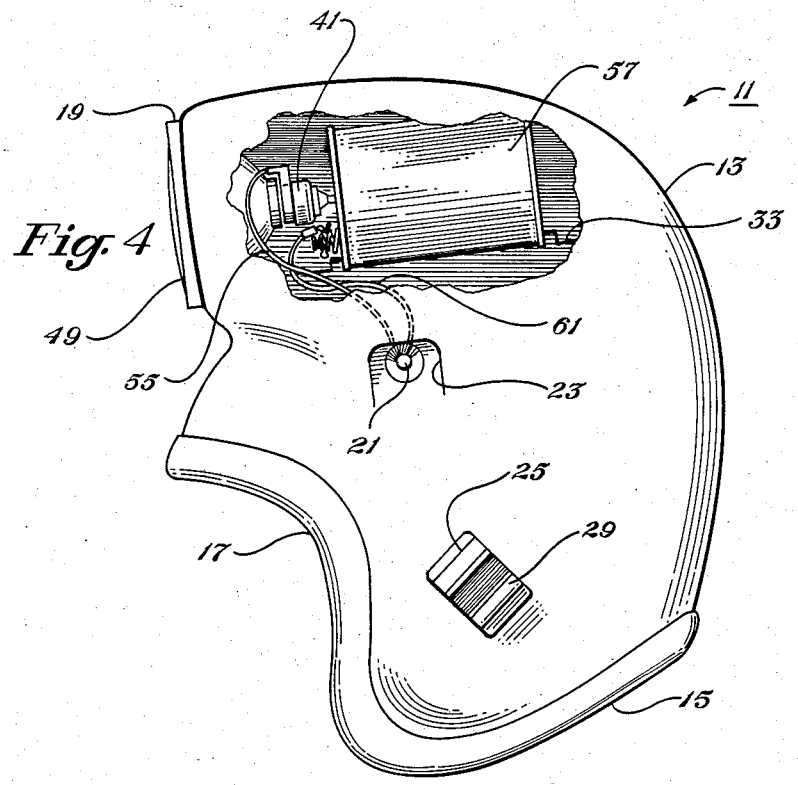
FIG. 4 is a side view of the helmet of FIG. 1, partially broken away to show the battery.

Referring to FIG. 4, a battery 57 is mounted in each cavity 33 rearwardly from cavity entrance 35 and lamp housing 37. The battery is installed and removed through cavity entrance 35, by first removing lamp housing 37. Battery 57 is connected to switch 21 by a wire 61.

Figure 5:
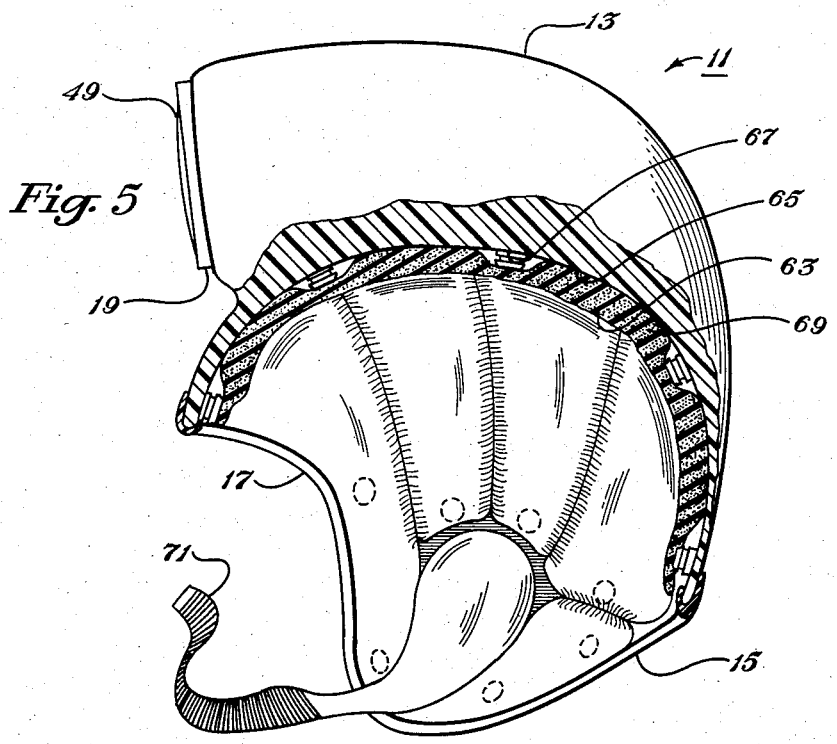
FIG. 5 is a side view of the helmet of FIG. 1, partially in section, to show the liner for the helmet of FIG. 1.

Referring to FIG. 5, a flexible, waterproof, and buoyant liner 63 is adapted to be snapped into the interior 65 of helmet 11. Preferably a plurality of snap fasteners 67 serve as mounting means for releasably retaining the liner 63 inside helmet 11. Liner 63 contains impermeable and buoyant cushioning material 69 such as neoprene rubber. The thickness of cushioning material 69 is selected so that it will provide a slight buoyant force. In fresh water, the helmet will have a slight upward force without the liner 63. Also, the liner 69 is the same thickness as the thickness of a conventional wet suit flexible hood or head covering, which usually is either ⅛ inch or ¼ inch thick. A wet suit hood will be larger in surface area than liner 63 since a hood covers part of the shoulder and face. Consequently, the buoyancy of liner 63 would be slightly less than that of a hood. A strap 71 is fastened to one side of the helmet for securing around the chin of the diver.

In operation, in warm water, the diver would place the liner 63 inside the helmet 11, and would not use a wet suit hood. For snorkling, the diver secures the snorkle tube 27 into the bracket 29. As the diver floats on the surface face down, liner 63 will ease neck strain by creating a upward force to add to the buoyancy of the helmet. Water will enter the interior of helmet 11 since the bottom and face are open. For illumination, light switch 21 is flipped to provide power from the battery 57 to the light source 41. To orient the light in other directions, the housing 37 is gripped by the diver and rotated until the desired direction is achieved. The offset mounting of the reflector 43 in housing 37, and the sliding engagement of housing 37 with cavity 35 serve as directional means for pointing the lamp in various directions with respect to the helmet. Should the diver wish to temporarily remove the mouthpiece of the snorkle tube 27, the bracket 25 will retain the tube substantially in place.

For scuba diving, in which air tanks are used for breathing, the snorkle tube 27 can be removed from the helmet by detaching it from bracket arms 29. Liner 63 may remain in place for warm water diving. This provides more maneouverability and visibility than if a hood is worn under the helmet, and greater comfort. If a hood is used, such as in cold water, the liner 63 would be removed. The space previously taken by the liner 63 would be filled by the hood. The bouyancy would remain about the same. The lights 29 are used in the same manner during scuba diving as in snorkling.

The invention has significant advantages. The helmet is versatile, convenient, and safe. The helmet has the battery for the lamp mounted within a sealed cavity, thus avoiding the problems of a separate battery pack and cord. The light can be moved to various directions for improved illumination. The switch for the light is recessed to avoid it being accidentally bumped through contacting an obstruction underwater. The snorkle bracket allows a snorkle tube to be used and retained with the helmet. The liner provides desired buoyancy during snorkling, but can be removed for scuba diving. The twin lights, each with its own separately sealed cavity and battery, provide emergency backup.

While the invention has been shown in only one of its forms, it should be apparent to those skilled in the art that it is not so limited but is susceptible to various changes and modifications without departing from the spirit of the invention.

I claim:

1. In a diving helmet of the type having a rigid exterior, an interior for receiving a diver's head, the interior being open at the bottom and face, the improvement comprising:

a cavity located in the top portion of the helmet, sealed from the interior of the helmet and having a cylindrical entrance facing forwardly;

a cylindrical lamp housing slidably and rotatably mounted in the entrance of the cavity, and having a light source contained therein;

seal means between the lamp housing and the entrance for sealing the cavity from water; and directional means for directing light from the light source at an acute angle with respect to the axis of the lamp housing, so that the light source will point in different directions as the lamp housing is rotated.

2. The helmet according to claim 1 wherein the cavity also has the capacity for containing a battery for powering the light source with the sole entrance to the cavity being the entrance containing the lamp housing, through which the battery is inserted prior to receiving the lamp housing.

3. The helmet according to claim 1 wherein a recess is formed in the exterior of the helmet, and a switch is mounted in the recess for controlling the light source, the switch protruding no farther from the recess than the exterior of the helmet.

4. In a diving helmet of the type having a rigid exterior, an interior for receiving the diver's head, the interior being open at the bottom and face, the improvement comprising:

a cavity integrally formed in the helmet in the top portion above the interior and below the exterior, with a cylindrical entrance facing forwardly;

a cylindrical lamp housing rotatably mounted in the entrance of the cavity and containing a light source;

the light source being located at the apex of a generally conical reflector, the reflector being mounted in the housing with its axis at an acute angle with respect to the axis of the lamp housing so that rotating the lamp housing points the axis of the reflector in different directions; and seal means between the lamp housing and the entrance for sealing the cavity from water;

a battery located inside the cavity for powering the light source.

5. The apparatus according to claim 4 wherein a recess is formed in the exterior of the helmet, and a switch is mounted in the recess for opening and closing a circuit from the battery to the light source.

6. A lamp for a diving helmet, comprising:

a rigid lamp base located at the top of the helmet, having a cylindrical forwardly facing opening;

a lamp housing having a cylindrical portion that is slidingly received in the base opening;

a generally conical reflector and light source carried in the cylindrical portion of the housing, with the axis of the reflector being at an acute angle with respect to the axis of the housing, so that rotating the housing sweeps the axis of the reflector in different directions;

the cylindrical portion of the housing protruding from the base opening to allow gripping by a diver for rotating the housing.

7. In a diving helmet of the type having a rigid exterior, an interior for receiving a diver's head, the interior being open at the bottom and face, the improvement comprising:

a flexible liner of buoyant material; and mounting means for releasably securing the liner to the interior of the helmet.

8. The helmet according to claim 7 wherein the mounting means comprises a plurality of snap fasteners.

9. In a diving helmet of the type having a rigid exterior, and an interior for receiving a diver's head, the interior being open at the bottom and face, the improvement comprising:

a bracket rigidly coupled to one side of the helmet, the bracket having a pair of resilient, inwardly curving arms for releasably gripping a portion of a snorkle tube.

10. In a diving helmet of the type having a rigid exterior, and an interior for receiving a diver's head, the interior being open at the bottom and face, the improvement comprising:

a watertight cavity located in the top portion of the helmet;

a forwardly facing lamp mounted in the cavity;

directional means for pointing the lamp in various directions with respect to the helmet;

a battery mounted in the cavity for powering the lamp;

a flexible liner of buoyant material;

mounting means for releasably securing the liner to the interior of the helmet; and a bracket coupled to the one side of the helmet, the bracket having a pair of resilient, inwardly curving arms, for releasably gripping a portion of a snorkle tube.

11. The helmet according to claim 10 further comprising:

a recess formed in the exterior of the helmet; and a switch mounted in the recess for controlling the lamp, the switch protruding no farther from the recess than the exterior of the helmet.

* * * * *